United States Patent [19]

Jordan

[11] 4,289,250

[45] Sep. 15, 1981

[54] EASY OPENING CONTAINER WITH TAB HAVING SEPARATE OPENING ELEMENT

[75] Inventor: Thomas F. Jordan, Oak Park, Ill.

[73] Assignee: The Continental Group, Inc., Stamford, Conn.

[21] Appl. No.: 144,006

[22] Filed: Apr. 28, 1980

[51] Int. Cl.[3] ..... B65D 17/34

[52] U.S. Cl. ..... 220/269; 220/277; 220/260; 220/270

[58] Field of Search ..... 220/267–273, 220/277

[56] References Cited

U.S. PATENT DOCUMENTS 1,856,543 5/1932 Ericsson ..... 220/270
3,371,818 3/1968 Bozek ..... 220/267
4,231,487 11/1980 Hasegawa ..... 220/269

*Primary Examiner*—George T. Hall
*Attorney, Agent, or Firm*—Charles E. Brown

[57] ABSTRACT

This relates to an easy opening container wherein a displaceable panel portion is defined by a line of weakness and has attached thereto an opening device. Most particularly, the opening device is formed of a length of flexible material, such as a tape, which is folded upon itself and has a lower leg bonded to the displaceable panel portion. The outer leg, which functions as a pull element, has secured thereto an opening element which extends beyond the fold and has a nose for effecting an axially inwardly directed opening force on the displaceable panel portion.

7 Claims, 4 Drawing Figures

EASY OPENING CONTAINER WITH TAB HAVING SEPARATE OPENING ELEMENT

This invention relates in general to new and useful improvements in easy opening containers, and more particularly to a container where the opening element is of a flexible construction, such as being in the form of a tape-like member.

In accordance with this invention, it is proposed to provide an opening device which is in the form of a length of tape-like material which is folded upon itself to define upper and lower portions, and wherein the upper portion has bonded thereto a separately formed opening element and the lower portion is bonded to a displaceable panel portion.

In accordance with this invention, the displaceable panel portion may be entirely removable from the container panel of which it is initially a part and will remain associated with the container panel by the opening device being bonded to the container panel adjacent the displaceable panel portion.

Most particularly, this invention relates to an easy opening device for effecting initially the rupture of a container panel along a line of weakness and then effecting the displacement of the panel portion out of the general plane of the panel. In accordance with this invention, the opening device is in the form of a length of tape-like material which is reversely folded upon itself to define two legs. One leg is bonded to the displaceable panel portion and the other leg has an opening device which, when the other leg is lifted, will be pivoted into engagement with the panel generally in alignment with an adjacent part of the line of weakness so as to exert an axially inwardly directed force on the panel and rupture of the line of weakness. A continued upward pull on the opening device will result in the displaceable panel portion being pulled out of the plane of the container panel.

With the above and other objects in view that will hereinafter appear, the nature of the invention will be more clearly understood by reference to the following detailed description, the appended claims, and the several views illustrated in the accompanying drawings.

Figure 1:
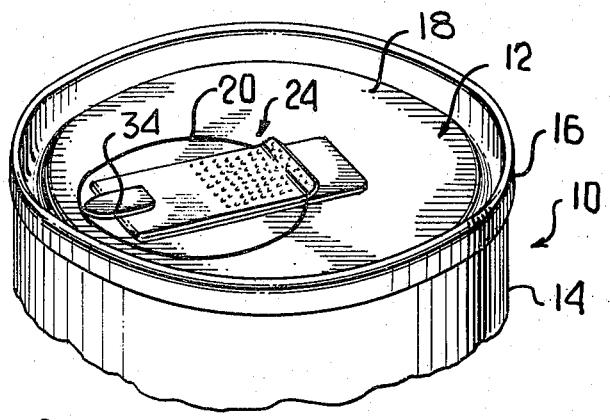
FIG. 1 is a top perspective view of a container having an end unit provided with the easy opening feature of this invention.
Figure 2:
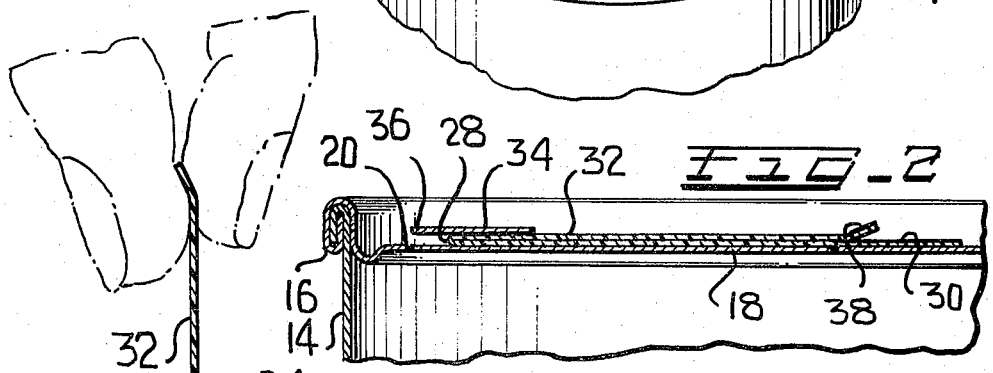
FIG. 2 is an enlarged fragmentary vertical sectional view taken generally through the center of the opening device of FIG. 1.

Referring now to the drawings in detail, it will be seen that there is illustrated a conventional container 10 which has one end thereof closed by an end unit, generally identified by the numeral 12. The end unit 12 is secured to a body 14 of the container 10 by way of a conventional double seam 16. The end unit 12 has an end panel 18 in which there is formed a line of weakness 20 in the form of a score. The line of weakness 20 defines a displaceable panel portion 22.

At this time is pointed out that while the container panel has been illustrated and is described as an end panel of an end unit, it is to be understood that the container panel 18 may be any panel portion of a container and that the invention is not limited to a conventional container of the type illustrated.

In order to facilitate rupture of the panel 18 along the line of weakness 20 and the displacement of the panel portion 22 from the general plane of the panel 18, there is provided an opening device, generally identified by the numeral 24. In its simplest form, the opening device 24 is in the form of a length of plastic material or tape 26 which is reversely folded upon itself as at 28 to define a lower leg or portion 30 and an upper leg or portion 32.

The upper leg 32 is provided with an opening element 34 which terminates beyond the fold 28 in a force applying nose 36 which may be pointed, as is shown in FIG. 1.

At this time, while it has been specifically illustrated and described that the member 26 is in the form of a plastic tape, it is also to be understood that the member 26 could be in the form of a laminate which would include a plastic underlayer and a metal overlayer, the metal being preferably aluminum foil.

The panel 18 may be suitably coated so that the leg 30 may be directly and permanently heat bonded to the coated end panel 18 or a suitable adhesive (not shown) may be utilized. In a like manner, the opening element 34 may be coated on its underside for direct heat bonding to the upper leg 32 or a suitable adhesive may be utilized.

Figure 3:
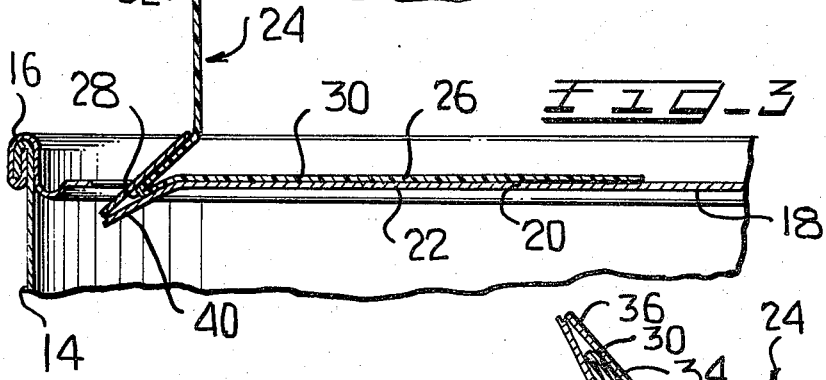
FIG. 3 is a sectional view similar to FIG. 2 and shows the upper leg of the opening device having been pulled upwardly and the opening element carried thereby having effected initial rupture of the container panel and the depressing of a part of the displaceable panel portion.

As is clearly evident from the drawings, the opening device 24 is so positioned relative to the line of weakness 20 that the nose 36 of the opening element 34 is generally aligned with an underlying portion of the line of weakness 20. When the second leg 32 is lifted, the free end 38 thereof being slightly elevated to facilitate grasping, the tape 26 will generally hinge along the fold 28, which defines a hinge line, until the nose 36 engages the panel 18. Further upward pulling on the upper leg 32 will result in the nose 36 applying sufficient downward pressure on the panel portion 22 to effect initial rupture of the line of weakness 20 and an inward bending of an adjacent portion, identified by the numeral 40, of the panel portion 22, as is shown in FIG. 3.

Figure 4:
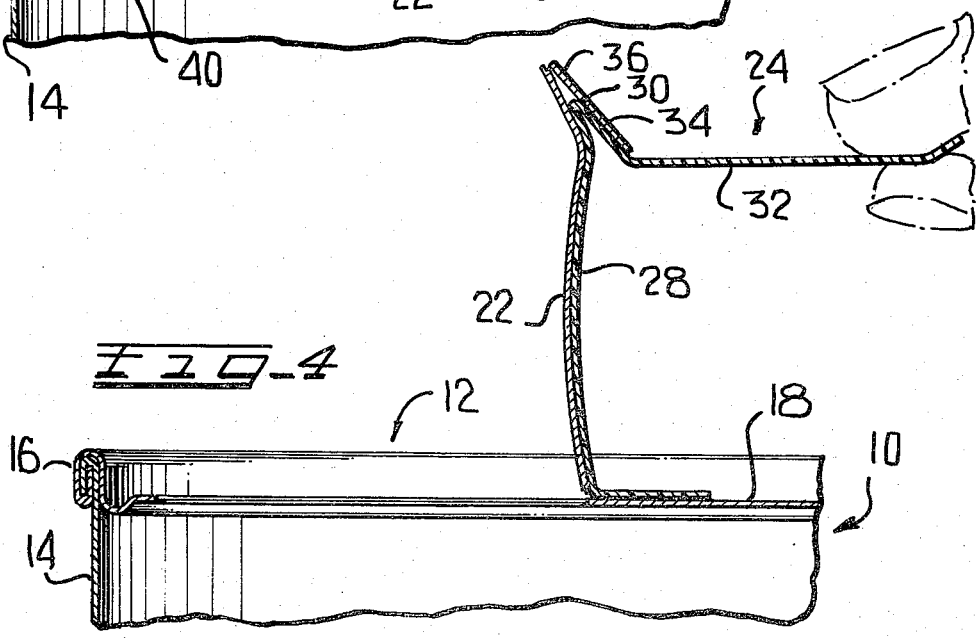
FIG. 4 is another sectional view similar to FIG. 3 and shows the opening device having been further pulled upwardly and to the right so as to effect the continued rupture of the panel along the line of weakness and the outward withdrawing of the displaceable panel portion.

Continued upward pull with the pull also being partially toward the right, as shown in FIG. 4, will result in the displaceable panel portion being fully torn from the panel 18 along the line of weakness 20 as shown in FIG. 4. Inasmuch as the end portion of the inner leg 30 remote from the fold 28 is permanently bonded to the adjacent portion of the panel 18, the displaced panel portion 22 will remain attached to the panel 18 in the manner shown in FIG. 4.

Although the illustrated opening configuraton is circular, it is to be understood that the specific configuration of the line of weakness 20 does not in and of itself form part of this invention. Further, it is feasible that the line of weakness not be continuous so that the displaceable panel portion 22 may possibly not be fully torn or displaced from the panel 18.

It is also feasible that the tape 22 be formed entirely of metal, such as aluminum foil, although for bonding purposes, a heat bondable plastic material is preferred for the formation of the tape 22.

Although only a preferred embodiment of the opening device has been specifically illustrated and described herein, it is to be understood that minor variations may be made in the opening device without departing from the spirit and scope of the invention as defined by the appended claims.

I claim:

1. An easy opening container component comprising a panel, a line of weakness in said panel defining a displaceable panel portion, and an opening device, said opening device including a pull member, said pull member being reversely folded and including first and second portions integrally connected along a transverse hinge line, said first portion overlying said displaceable panel portion and being permanently secured thereto with said hinge line being in spaced adjacent relation to an adjoining portion of said line of weakness, said second portion generally overlying said first portion and including a grip part remote from said hinge line, and an opening element permanently secured to said second portion adjacent said hinge line and projecting beyond said hinge line, said opening element terminating in a force applying end generally aligned with said line of weakness adjoining portion.

2. A container component according to claim 1 wherein said line of weakness is a continuous line, said displaceable panel portion is removable from said panel, and said first portion extends beyond said displaceable panel portion and is permanently secured to said panel adjacent said displaceable panel portion.

3. A container component according to claim 1 wherein said pull member is formed of a flexible material and said opening element is formed of a rigid material.

4. A container component according to claim 3 wherein said pull member is in the form of a tape.

5. A container component according to claim 1 wherein said pull member is in the form of a tape.

6. A container component according to claim 1 wherein said pull member is in the form of a tape, and is secured to said opening element and said displaceable panel portion by bonding.

7. A method of displacing a panel portion defined in a panel by a line of weakness, said method comprising the steps of providing a flexible member, securing the flexible member to said displaceable panel portion and to an opening element, pulling on said flexible member to first force the opening element against the displaceable panel portion to initiate rupture of the panel along the line of weakness, and then further pulling on the flexible member to continue rupture of the panel along the line of weakness and to withdraw the removable panel portion from the panel.

* * * * *